US008932011B2

(12) United States Patent
Mundell et al.

(10) Patent No.: US 8,932,011 B2
(45) Date of Patent: Jan. 13, 2015

(54) SHAFT ASSEMBLY FOR A GAS TURBINE ENGINE

(75) Inventors: Eric C. Mundell, South Berwick, ME (US); Todd M. LaPierre, Middleton, NH (US); Marc J. Muldoon, Marlborough, CT (US); Stephen J. Lyle, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 610 days.

(21) Appl. No.: 13/267,539

(22) Filed: Oct. 6, 2011

(65) Prior Publication Data

US 2013/0089432 A1 Apr. 11, 2013

(51) Int. Cl.
*F01D 5/02* (2006.01)
*F01D 5/06* (2006.01)

(52) U.S. Cl.
CPC ..... *F01D 5/025* (2013.01); *F01D 5/066* (2013.01); *F05D 2260/941* (2013.01); *F05D 2260/31* (2013.01)
USPC ..... 415/198.1; 415/199.4; 415/216.1; 415/229; 415/230; 416/198 A; 416/204 A; 416/244 A

(58) Field of Classification Search
USPC ..... 415/198.1, 199.4, 216.1, 229, 230; 416/198 A, 198 R, 204 A, 244 A
See application file for complete search history.

(56) References Cited

U.S. PATENT DOCUMENTS 3,602,535 A * 8/1971 Behning et al. ..... 403/118
3,718,957 A * 3/1973 Shank ..... 415/143
3,722,058 A * 3/1973 Corsmeier ..... 29/270
3,823,553 A * 7/1974 Smith ..... 415/190
4,611,464 A * 9/1986 Hetzer et al. ..... 415/189
5,131,782 A * 7/1992 Bruno et al. ..... 403/259
5,220,784 A * 6/1993 Wilcox ..... 416/198 A
5,533,863 A 7/1996 Tornquist et al.
5,537,814 A * 7/1996 Nastuk et al. ..... 60/796
5,580,183 A * 12/1996 Brackoneski et al. ..... 415/216.1
5,626,347 A 5/1997 Ullah
6,322,081 B1 11/2001 Ullah et al.
6,375,421 B1 * 4/2002 Lammas et al. ..... 415/199.5
7,410,173 B2 8/2008 Justak
7,926,260 B2 4/2011 Sheridan et al.
2002/0081199 A1 6/2002 Pepi et al.
2005/0013696 A1 * 1/2005 Le Jeune et al. ..... 416/244 A
2009/0205341 A1 8/2009 Muldoon
2010/0244385 A1 9/2010 Ullah
2010/0303610 A1 12/2010 Wang et al.
2011/0052372 A1 * 3/2011 Lecuyer et al. ..... 415/115
2011/0146298 A1 6/2011 Reinhardt et al.
2011/0223026 A1 9/2011 Benjamin et al.

* cited by examiner

*Primary Examiner* — Igor Kershteyn
(74) *Attorney, Agent, or Firm* — O'Shea Getz P.C.

(57) ABSTRACT

A shaft assembly for a gas turbine engine that includes a shaft with a threaded shaft segment, an annular rotor disposed on the shaft, and annular stack nut. The stack nut includes a base nut segment and a clamping nut segment. The base nut segment includes a threaded nut bore that is mated with the threaded shaft segment. The clamping nut segment axially extends from the base nut segment to a load bearing surface. The clamping nut segment includes a radial thickness that decreases as the clamping nut segment extends from the load bearing surface towards the base nut segment. The load bearing surface exerts a force against the rotor securing the rotor to the shaft.

17 Claims, 3 Drawing Sheets

SHAFT ASSEMBLY FOR A GAS TURBINE ENGINE

BACKGROUND OF THE INVENTION

1. Technical Field

This disclosure relates generally to a gas turbine engine and, more particularly, to a shaft assembly for a gas turbine engine that includes a stack nut.

2. Background Information

Various shaft assemblies for gas turbine engines are known in the art. One type of shaft assembly includes an engine shaft, a rotor, a stack nut and a stator. The rotor is typically mounted onto the shaft between the stack nut and a shaft shoulder. The rotor includes a rotor contact sealing surface, and the stator includes a stator contact sealing surface. The rotor contact sealing surface is arranged in sealing contact with the stator contact sealing surface to reduce fluid leakage therebetween.

During operation, the stack nut may be subject to a thermal gradient. The thermal gradient may cause different regions of the stack nut to thermally expand at different rates and warp. A clamping force exerted by the stack nut against the rotor therefore may become non-uniform. Such a non-uniform clamping force may cause the rotor to warp and disrupt the sealing contact between the rotor and stator contact sealing surfaces and, thus, allow fluid leakage therebetween. Such fluid leakage may disadvantageously reduce engine efficiency, increase engine wear, cause engine component failure, etc.

SUMMARY OF THE DISCLOSURE

According to a first aspect of the invention, a shaft assembly is provided for a gas turbine engine that includes a shaft with a threaded shaft segment, an annular rotor disposed on the shaft, and annular stack nut. The stack nut includes a base nut segment and a clamping nut segment. The base nut segment includes a threaded nut bore that is mated with the threaded shaft segment. The clamping nut segment axially extends from the base nut segment to a load bearing surface. The clamping nut segment includes a radial thickness that decreases as the clamping nut segment extends from the load bearing surface towards the base nut segment. The load bearing surface exerts a force against the rotor securing the rotor to the shaft.

According to a second aspect of the invention, a shaft assembly is provided for a gas turbine engine that includes a shaft with a threaded shaft segment, an annular rotor disposed on the shaft, an annular stack nut, and an annular seal. The stack nut includes a base nut segment arranged axially between a load bearing surface and a seal land nut segment. The base nut segment includes a threaded nut bore that is mated with the threaded shaft segment. The load bearing surface exerts an axial force against the rotor securing the rotor to the shaft. The annular seal engages the seal land nut segment.

According to a third aspect of the invention, a shaft assembly is provided for a gas turbine engine that includes a shaft with a threaded shaft segment, an annular rotor disposed on the shaft, and an annular stack nut. The stack nut includes a base nut segment arranged axially between a load bearing surface and a torquing nut segment. The base nut segment includes a threaded nut bore that is mated with the threaded shaft segment. The load bearing surface exerts an axial force against the rotor securing the rotor to the shaft. The torquing nut segment comprises an inner castellated bore.

The foregoing features and operation of the invention will become more apparent in light of the following description and the accompanying drawings.

DETAILED DESCRIPTION OF THE INVENTION

Figure 1:
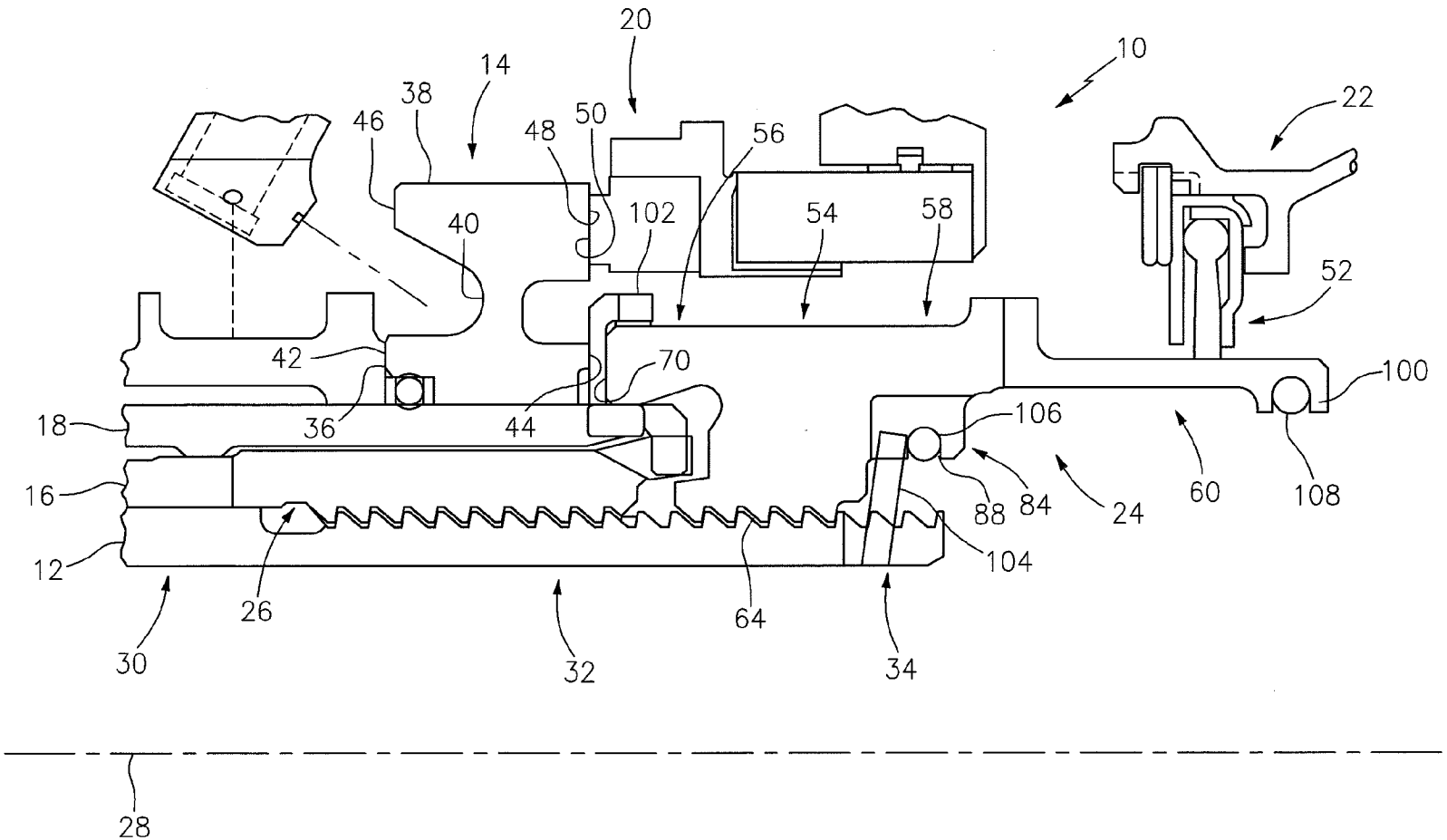
FIG. 1 is a cross-sectional illustration of a shaft assembly for a gas turbine engine.

FIG. 1 is a cross-sectional illustration of a shaft assembly 10 for a gas turbine engine. The shaft assembly 10 includes an engine shaft 12, one or more annular rotors 14, 16, 18, one or more annular stators 20, 22, and one or more annular stack nuts 24, 26.

The shaft 12 is rotatable about an axial centerline 28. The shaft 12 includes an axially extending first shaft segment 30 and an axially extending threaded shaft segment 32 with a castellated end 34.

The rotors may include a first rotor 14, a second rotor 16 and a third rotor 18. The first rotor 14 includes a clamping segment 36, a sealing segment 38 and a bridge segment 40. The clamping segment 36 extends axially between a first radial clamping surface 42 and a second radial clamping surface 44. The sealing segment 38 extends axially between a first end 46 and a radial distortion resistant contact sealing surface 48 at a second end. The bridge segment 40 extends radially between the clamping segment 36 and the sealing segment 38. An alternative example of a first rotor configuration is disclosed in U.S. patent applicant Ser. No. 12/415,427, which is hereby incorporated by reference in its entirety.

The stators may include a first stator 20 and a second stator 22. The first stator 20 includes a radial contact sealing surface 50. The second stator 22 includes an annular seal 52 (e.g., a brush seal, a knife edge seal, a contact seal surface, a sacrificial seal surface, etc.). The stack nuts may include a first stack nut 24 and a second stack nut 26.

Figure 2:
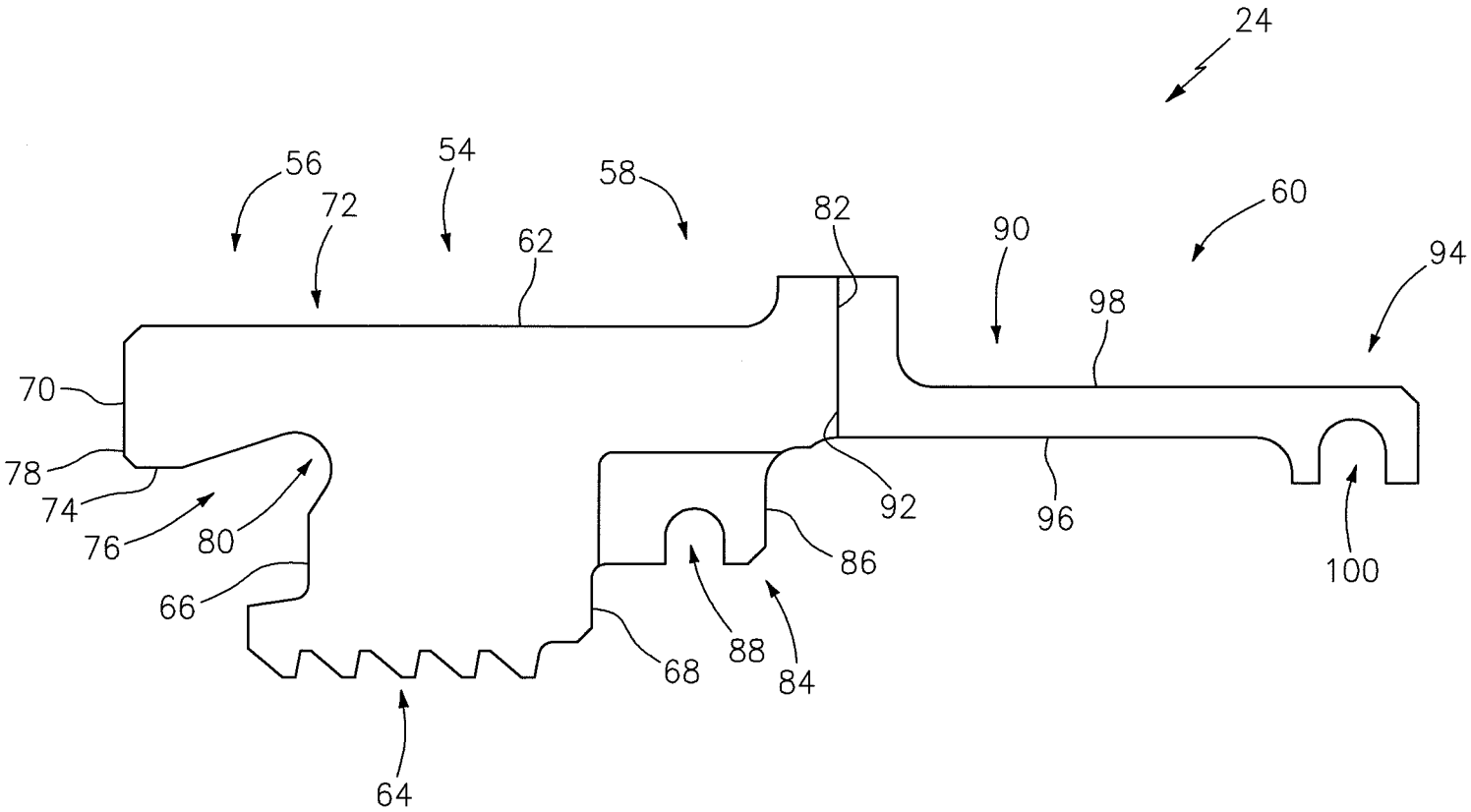
FIG. 2 is a cross-sectional illustration of a stack nut included in the shaft assembly illustrated in FIG. 1.
Figure 3:
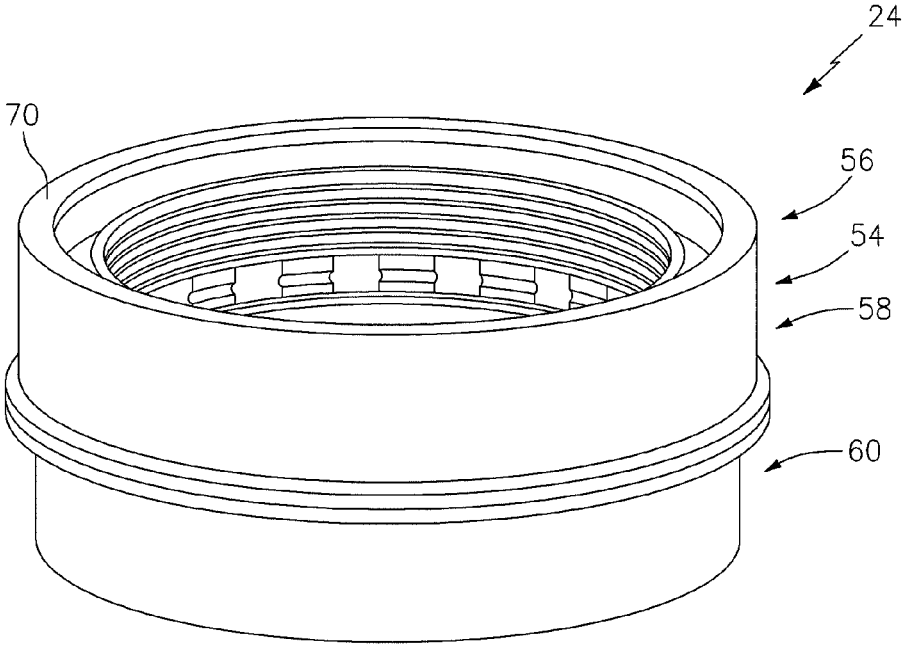
FIG. 3 is a perspective illustration of the stack nut illustrated in FIG. 2.
Figure 4:
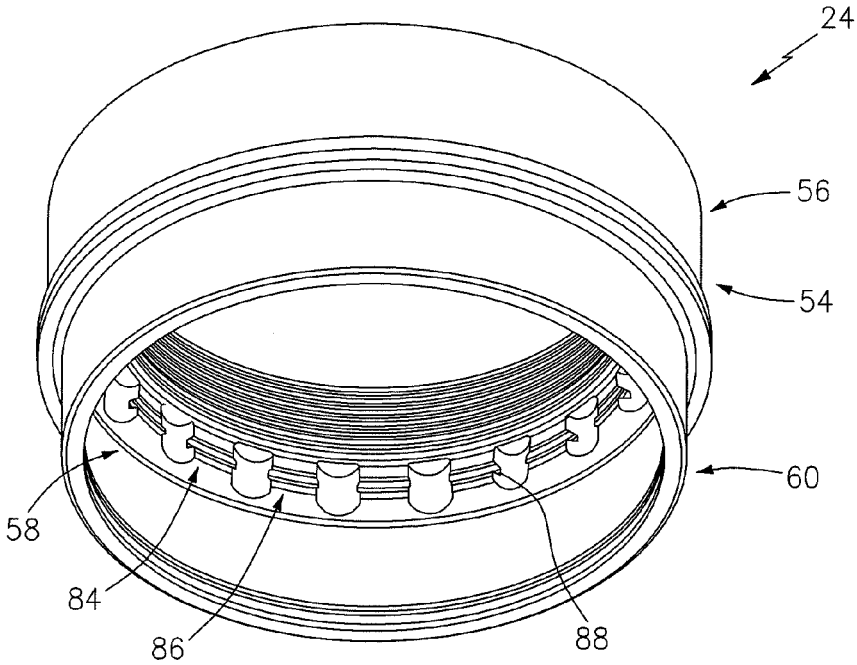
FIG. 4 is another perspective illustration of the stack nut illustrated in FIG. 2.

FIG. 2 is a cross-sectional illustration of the first stack nut 24. FIGS. 3 and 4 are perspective illustrations of the first stack nut 24. Referring to FIGS. 2-4, the first stack nut 24 includes an annular base nut segment 54, an annular clamping nut segment 56, an annular torquing nut segment 58, and an annular seal land nut segment 60.

Referring to FIG. 2, the base nut segment 54 extends radially between a threaded nut bore 62 and an axial exterior nut surface 64. The base nut segment 54 extends axially between a first radial surface 66 and a second radial surface 68.

The clamping nut segment 56 extends axially from the base nut segment 54, adjacent the first radial surface 66, to a distortion resistant load bearing surface 70. The load bearing surface 70 at least partially overlaps an intersection 72 between the clamping nut segment 56 and the base nut segment 54. The clamping nut segment 56 also extends radially between a radial inner, axial surface 74 and the exterior nut surface 64. In some embodiments, an annular channel 76 extends into a corner between the radial inner, axial surface 74 and the first radial surface 66. The channel 76 may extend diagonally (e.g., along an axis acute to the centerline 28) such that a radial thickness of the clamping nut segment 56 decreases as the clamping nut segment 56 extends from the load bearing surface 70 towards the base nut segment 54. The channel 76 is disposed radially between a radial inner end 78 of the load bearing surface 70 and the base nut segment 54. The channel 76 may include an end 80 with a curved (e.g., arcuate, semi-circular, etc.) cross-sectional geometry.

The torquing nut segment 58 extends axially from the base nut segment 54, adjacent the second radial surface 68, to a seal land nut segment contact surface 82. The torquing nut segment 58 extends radially between an inner castellated bore 84 and the exterior nut surface 64. Referring to FIGS. 2 and 4, the castellated bore 84 includes a plurality of radially inward extending protrusions 86 (e.g., splines). The protrusions 86 are sized and circumferentially arranged to mate with corresponding notches in a tool (not shown) for screwing the first stack nut 24 onto the threaded shaft segment 32 (see FIG. 1). Each protrusion 86 may include a circumferentially extending notch 88.

Referring to FIG. 2, the seal land nut segment 60 includes a seal segment 90 that extends axially from a torquing nut segment contact surface 92 to a channeled segment 94. The seal segment 90 extends radially between a radial inner, axial surface 96 and a radial outer, axial seal land surface 98. The channeled segment 94 includes a circumferentially extending channel 100. The torquing nut segment contact surface 92 is connected (e.g., welded) to the seal land nut segment contact surface 82.

Referring to FIG. 1, the second rotor 16 is disposed on the first shaft segment 30, and fixedly secured between the second stack nut 26 and a shaft shoulder (not shown). The third rotor 18 is disposed on and fixedly secured to the second rotor 16 and the second stack nut 26. The clamping segment 36 is disposed on the third rotor 18, and fixedly secured between the clamping segment 36 and a shaft shoulder (not shown). In particular, the threaded nut bore 62 is threaded onto the threaded shaft segment 32 such that the load bearing surface 70 exerts an axial clamp force against the second radial clamping surface 44. The radial contact sealing surface 50 contacts the distortion resistant contact sealing surface 48 forming a seal therebetween. The annular seal 52 engages the axial seal land surface forming a seal therebetween.

An anti-rotation washer 102 may be arranged between the load bearing surface 70 and the second radial clamping surface 44 to prevent the first rotor 14 from rotating as the stack nut is threaded onto the shaft 12. A keyed washer 104 may be mated with the castellated bore 84 and the castellated end 34 of the threaded shaft segment 32 to prevent rotation of the first stack nut 24 during engine operation. A retaining ring 106 may be seated within the notches 88 to hold the keyed washer 104 in position. A damping ring 108 may be seated within the channel 100 to dampen vibrations within the first stack nut 24.

During operation, the first stack nut 24 may be subjected to a thermal gradient. The thermal gradient may cause different regions of the first stack nut 24 to thermally expand at different rates. In contrast to the stack nut described above in the background section, however, the segments of the first stack nut 24 are configured to thermally expand in a manner that may maintain a substantially uniform axial clamp force against the second radial clamping surface 44. The clamping nut segment 56, for example, may thermally expand in a manner that maintains the load bearing surface 70 in a substantially perpendicular orientation relative to the shaft 12. Disruptive effects to the seal between the first rotor 14 and the first stator 20 caused by thermal expansion within the first stack nut 24 therefore may be reduced relative to prior art shaft assemblies.

In some embodiments, the first stack nut 24 may be configured such that the load bearing surface 70 cones towards or away from the first rotor 14 in order to increase or reduce the axial force against the second radial clamping surface 44.

In some embodiments, the seal land nut segment 60 may be formed integral with the torquing nut segment 58. In other embodiments, the clamping nut segment 56 and/or the torquing nut segment 58 may be connected (e.g., welded) to the base nut segment 54.

In some embodiments, the clamping nut segment 56, the torquing nut segment 58 and/or the seal land nut segment 60 may be omitted from the first stack nut 24.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A shaft assembly for a gas turbine engine, comprising:
a shaft comprising a threaded shaft segment;
an annular rotor disposed on the shaft; and
an annular stack nut comprising
a base nut segment comprising a threaded nut bore that is mated with the threaded shaft segment; and
a clamping nut segment axially extending from the base nut segment to a load bearing surface, and comprising a radial thickness that decreases as the clamping nut segment extends from the load bearing surface towards the base nut segment, wherein the load bearing surface exerts a force against the rotor securing the rotor to the shaft;
wherein the load bearing surface at least partially radially overlaps an intersection between the clamping nut segment and the base nut segment.

2. The shaft assembly of claim 1, wherein the load bearing surface remains substantially perpendicular to the shaft as a temperature of the stack nut changes during engine operation.

3. The shaft assembly of claim 1, wherein the stack nut further comprises a torquing nut segment comprising an inner castellated bore, and the base nut segment is connected axially between the clamping nut segment and the torquing nut segment.

4. A shaft assembly for a gas turbine engine, comprising:
a shaft comprising a threaded shaft segment;
an annular rotor disposed on the shaft; and
an annular stack nut comprising
a base nut segment comprising a threaded nut bore that is mated with the threaded shaft segment; and
a clamping nut segment axially extended from the base nut segment to a load bearing surface, and comprising a radial thickness that decreases as the clamping nut segment extends from the load bearing surface towards the base nut segment, wherein the load bearing surface exerts a force against the rotor securing the rotor to the shaft;
wherein the stack nut further comprises an annular channel that extends diagonally into a radial inner, axial surface of the clamping nut segment and a radial surface of the base nut segment.

5. The shaft assembly of claim 4, wherein the channel is disposed radially between a radial inner end of the load bearing surface and the base nut segment.

6. The shaft assembly of claim 4, wherein the channel comprises an end with a curved cross-sectional geometry.

7. A shaft assembly for a gas turbine engine, comprising:
a shaft comprising a threaded shaft segment;
an annular rotor disposed on the shaft;
an annular stack nut comprising a base nut segment comprising a threaded nut bore that is mated with the threaded shaft segment; and a clamping nut segment axially extending from the base nut segment to a load bearing surface, and comprising a radial thickness that decreases as the clamping nut segment extends from the load bearing surface towards the base nut segment, wherein the load bearing surface exerts a force against the rotor securing the rotor to the shaft; and an annular seal that engages a seal land nut segment of the stack nut, wherein the base nut segment is connected axially between the clamping nut segment and the seal land nut segment.

8. The shaft assembly of claim 7, wherein the seal engages an axial seal land surface of the seal land nut segment.

9. The shaft assembly of claim 7, wherein the stack nut further comprises a torquing nut segment connected axially between the base nut segment and the seal land nut segment, and the torquing nut segment comprises an inner castellated bore.

10. A shaft assembly for a gas turbine engine, comprising:

a shaft comprising a threaded shaft segment;

an annular rotor disposed on the shaft;

an annular stack nut comprising a base nut segment arranged axially between a load bearing surface and a seal land nut segment, wherein the base nut segment comprises a threaded nut bore that is mated with the threaded shaft segment, and wherein the load bearing surface exerts a force against the rotor securing the rotor to the shaft; and an annular seal that engages the seal land nut segment.

11. The shaft assembly of claim 10, wherein the seal engages an axial seal land surface of the seal land nut segment.

12. The shaft assembly of claim 10, wherein the stack nut further comprises a torquing nut segment connected axially between the base nut segment and the seal land nut segment, and the torquing nut segment comprises an inner castellated bore.

13. The shaft assembly of claim 10, wherein the stack nut further comprises a clamping nut segment axially extending from the base nut segment to the load bearing surface, and comprising a radial thickness that decreases as the clamping nut segment extends from the load bearing surface towards the base nut segment.

14. The shaft assembly of claim 13, wherein the load bearing surface at least partially radially overlaps an intersection between the clamping nut segment and the base nut segment.

15. A shaft assembly for a gas turbine comprising:

a shaft comprising a threaded shaft segment;

an annular rotor disposed on the shaft an annular stack nut comprising a base nut segment arranged axially between a load bearing surface and a torquing nut segment, wherein the base nut segment comprises a threaded nut bore that is mated with the threaded shaft segment, the load bearing surface exerts a force against the rotor securing the rotor to the shaft, and the torquing nut segment comprises an inner castellated bore; and an annular seal that engages a seal land nut segment of the stack nut, wherein the torquing nut segment is connected axially between the base nut segment and the seal land nut segment.

16. The shaft assembly of claim 15, wherein the seal engages an axial seal land surface of the seal land nut segment.

17. A shaft assembly for a gas turbine, comprising:

a shaft comprising a threaded shaft segment;

an annular rotor disposed on the shafts and an annular stack nut comprising a base nut segment arranged axially between a load bearing surface and a torquing nut segment, wherein the base nut segment comprises a threaded nut bore that is mated with the threaded shaft segment, the load bearing surface exerts a force against the rotor securing the rotor to the shaft and the torquing nut segment comprises an inner castellated bore;

wherein the stack nut further comprises a clamping nut segment axially extending from the base nut segment to the load bearing surface, and comprising a radial thickness that decreases as the clamping nut segment extends from the load bearing surface towards the base nut segment; and wherein the load bearing surface at least partially radially overlaps an intersection between the clamping nut segment and the base nut segment.

* * * * *